US005310061A

United States Patent [19]

Kanbar

[11] Patent Number: 5,310,061

[45] Date of Patent: May 10, 1994

[54] WORD-PUZZLE GAME CARTRIDGE

[76] Inventor: Maurice S. Kanbar, 4 E. 77th St., New York, N.Y. 10021

[21] Appl. No.: 881,169

[22] Filed: May 11, 1992

[51] Int. Cl.[5] ..... B65D 1/34; B65D 6/04

[52] U.S. Cl. ..... 206/555; 220/339; 220/4.23; 220/555; 220/326; 273/295

[58] Field of Search ..... 220/4, 23, 555, 339, 220/324, 326; 206/387, 425, 555; 273/295

[56] References Cited

U.S. PATENT DOCUMENTS

| | | | |
|---|---|---|---|
| 3,143,348 | 8/1964 | Carsen et al. | 273/302 X |
| 3,315,718 | 4/1967 | Berman | 220/555 |
| 3,891,070 | 6/1975 | Montanari | 220/4.23 X |
| 3,902,598 | 10/1975 | Koob et al. | 220/4.23 X |
| 4,060,173 | 11/1977 | Dahl | 220/4.23 |
| 5,090,568 | 2/1992 | Tse | 220/4.23 X |
| 5,131,551 | 6/1992 | Wells | 220/4.23 |
| 5,152,710 | 10/1992 | Montgomery | 220/4.23 X |
| 5,220,999 | 6/1993 | Goulette | 220/4.23 X |

FOREIGN PATENT DOCUMENTS

| | | | |
|---|---|---|---|
| 0451774 | 10/1991 | European Pat. Off. | 220/4.23 |
| 8800282 | 9/1989 | Netherlands | 220/555 |
| 2189222 | 10/1987 | United Kingdom | 220/4.23 |

*Primary Examiner*—William E. Stoll
*Attorney, Agent, or Firm*—Michael Ebert

[57] ABSTRACT

A cartridge in a book format for accommodating two decks of word-puzzle playing cards. The cartridge includes a top plate and a like base plate simulating the front and rear covers of a book whose inner surfaces, when the book is closed, are then in parallel relation. The top and base plate are interhinged by a slat that simulates the spine of the book. Formed on the inner surface of the base plate are two side-by-side compartments, the two decks of cards being received in these compartments. Formed on the inner surface of the top plate is a rectangular flange within which the two compartments nest when the book is closed, the flange then simulating the pages normally sandwiched between the covers of the book. Printed on the face of each card is a puzzle represented by two words, each having the same number of letters. In order for a player to win a point in the game, he must within a given time transform the first word into the second by changing a single letter in the first word or by rearranging its letters to make another word, until by a series of such transformations he creates the second word.

6 Claims, 2 Drawing Sheets

Fig. 1.
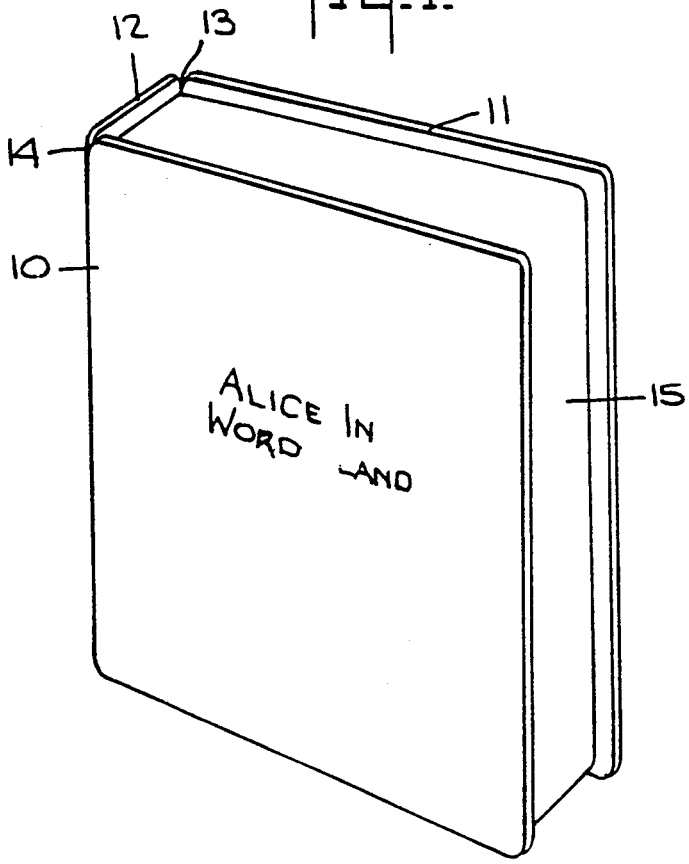
Fig. 2.
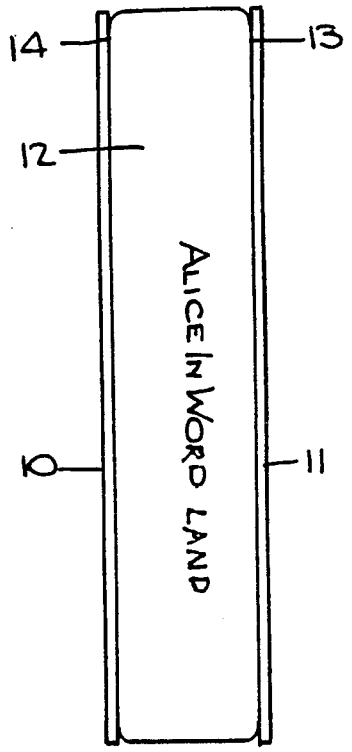
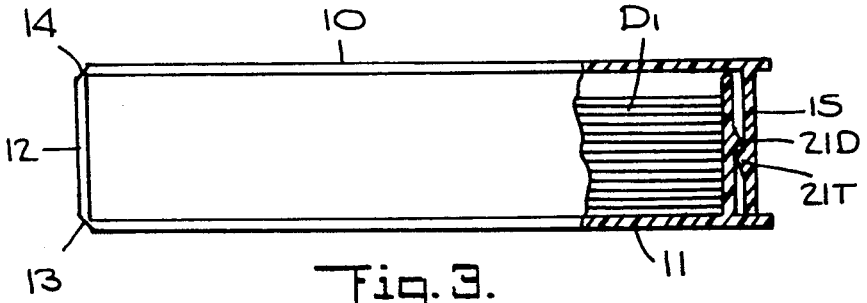
Fig. 3.
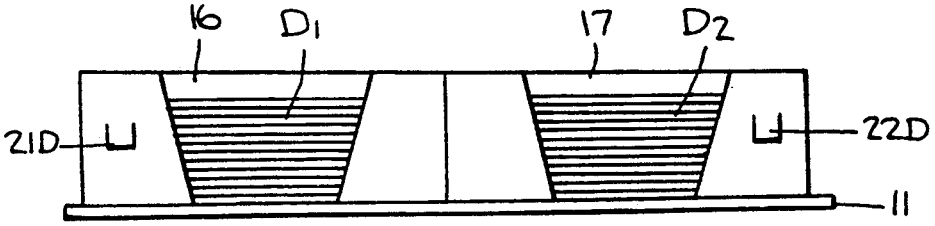
Fig. 5.

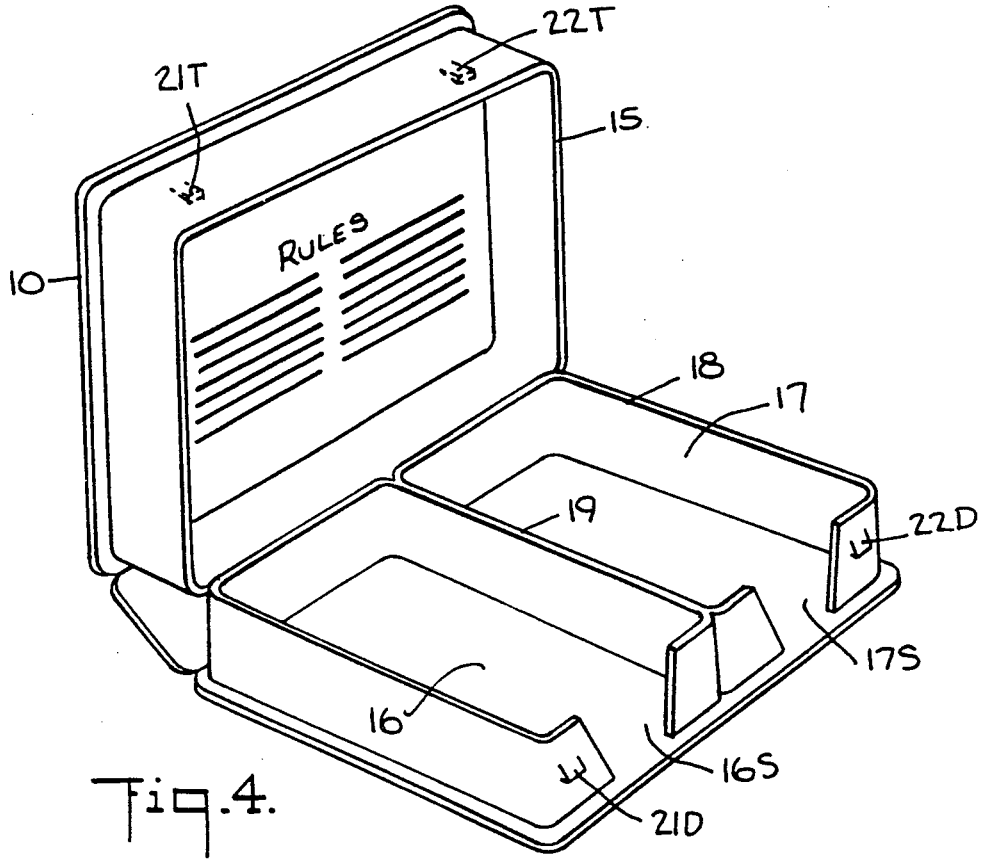
Fig. 4.
Fig. 6.
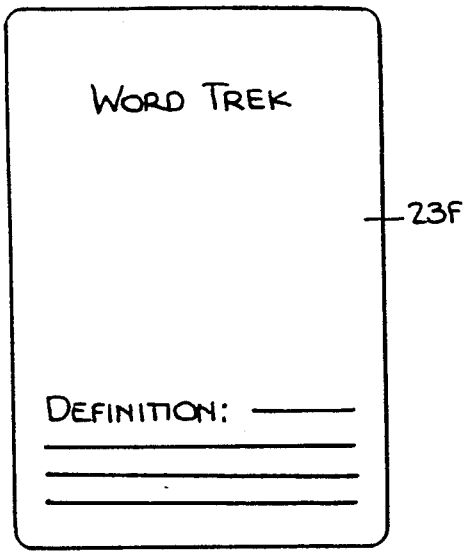
Fig. 7.
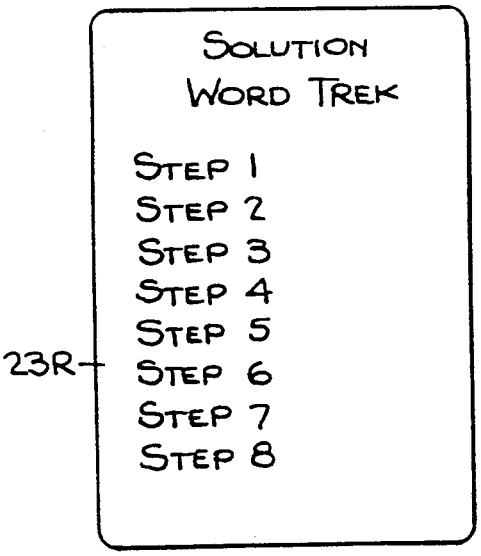

WORD-PUZZLE GAME CARTRIDGE

BACKGROUND OF INVENTION

1. Field of Invention

This invention relates generally to word-puzzle games, and in particular to a cartridge in a book format accommodating two decks of cards on each of which is printed a two-word puzzle, the arrangement being such that when the cartridge is in its open book state, cards may then be drawn from the deck by players of the game.

2. Status of Prior Art

Lewis Carroll, the pen name of a 19th Century English writer and mathematician, whose mathematical works are now almost forgotten, wrote Alice's Adventures in Wonderland in 1865 and thereby achieved a measure of immortality. While intended for children, it is now a favorite among literate adults, not only because of the fanciful characters created by Carroll, but also by reason of his ingenious and playful use of the English language.

Lewis Carroll's fascination with the multiple meanings of even simple words and the fact that by changing a single letter in a word, one then had a new word having an altogether different meaning, led him to invent a word puzzle game in which the player is presented with a phrase containing two words, each having the same number of letters. In order to win a point in this game, the player must succeed within a given time in so transforming the first word as to create the second word. To this end, the player is permitted to either change one letter in the first word or to rearrange the letters which form this word to make another word, until by a series of such transformations he arrives at the second word.

To give a simple example, we shall assume that the phrase presented to a player is "OPT to leave a TIP;" hence the words forming the puzzle are OPT TIP. In order to transform OPT to TIP and thereby score one point, the player first changes OPT TO TOP by rearranging the letter, and he then changes TOP to TIP by replacing O with I.

Another and more difficult example is WORD TREK. To solve this word puzzle so as to transform the first word WORD to the second word TREK, the player must first change WORD to WORE. He must then change WORD to WARE, then change WARE TO WEAR, change WEAR to REAR, change REAR to REEL, and change REEL to REEF. The player then must rearrange the letters of REEF to spell FREE, and then change FREE to TREE. Finally, the player must change TREE to TREK.

Thus while some word pairs are not too difficult to transform to derive the second word from the first, in other cases it requires a great deal of ingenuity to effect the necessary transformation within a predetermined time period.

SUMMARY OF INVENTION

The main object of this invention is to provide a cartridge to accommodate two decks of word-puzzle cards, each card having printing on its face two puzzle words having the same number of letters, the cartridge facilitating the playing of this game.

A significant advantage of a cartridge in accordance with the invention is that it makes it convenient to play this word puzzle anywhere as either a party game or as a solitaire exercise. The game serves to enlarge a player's vocabulary, and to improve his spelling as well as his verbal skills. And because it puts him into competition with other players who may possess a greater skill in manipulating words, it stimulates his interest in words and their meanings.

More particularly, an object of this invention is to provide a cartridge of the above type in a book format so that the words to be played with are effectively within the cover of a book which may be stored on a shelf or elsewhere in the manner of an ordinary book.

Also an object of this invention is to provide a book-like cartridge which is molded of synthetic plastic material as a unitary structure.

Briefly stated, these objects are attained in a cartridge in a book format for accommodating two decks of word-puzzle playing cards. The cartridge includes a top plate and a like base plate simulating the front and rear covers of a book whose inner surfaces, when the book is closed, are then in parallel relation. The top and base plate are interhinged by a slat that simulates the spine of the book. Formed on the inner surface of the base plate are two side-by-side compartments, the two decks of cards being received in these compartments. Formed on the inner surface of the top plate is a rectangular flange within which the two compartments nest when the book is closed, the flange then simulating the pages sandwiched between the covers of the book. Printed on the face of each card is a puzzle represented by two words each having the same number of letters. In order for a player to win a point in the game, he must within a given time transform the first word into the second by changing a single letter in the first word or by rearranging its letter to make another word, until by a series of such transformations he creates the second word.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a book-like cartridge for a word puzzle game in accordance with the invention;

FIG. 2 shows the spine or backbone of the cartridge;

FIG. 3 is an end view of the cartridge;

FIG. 4 shows the cartridge in its open book state;

FIG. 5 is an end view showing two decks of playing cards loaded in the two compartments of the cartridge;

FIG. 6 is a front face view of one of the playing cards; and

FIG. 7 is a rear face view of the card.

DESCRIPTION OF INVENTION

Referring now to FIGS. 1 to 3, there is shown in these figures a cartridge in a book format in which there is stored two decks of word-puzzle playing cards. Because the cartridge is book-like and the word puzzle is the one invented by Lewis Carroll, we have in recognition of this fact titled the book-like cartridge ALICE IN WORDLAND. The title appears on the front cover and also on the spine or backbone of the book.

The cartridge is constituted by a top plate 10 which simulates the front cover of a hard cover book, a base plate 11 of the same dimensions and thickness which simulates the rear cover. The backbone or spine of the book is simulated by a narrow slat 12, one edge of which is hinged to the adjacent edge of base plate 11 by a living hinge 13, the other edge of slat 12 being hinged by a living hinge 14 to top plate 10. A rectangular frame 15 having rounded corners which is integral with the inner face of top plate 10 simulates the pages of a book sandwiched between its covers.

As shown in FIGS. 4 and 5, formed on the inner surface of base plate 11 and integral therewith is a pair of like rectangular compartments 16 and 17 which are dimensioned to accommodate two decks $D_1$ and $D_2$ of playing cards. The compartments are defined by a generally rectangular wall 18 divided by a transverse partition wall 19 into the two compartments, this wall being common to both compartments. The front end walls of compartments 16 and 17 have finger slots 16S and 17S cut therein to afford ready access to the cards of decks $D_1$ and $D_2$ stacked therein. In this way, a player may easily withdraw a card from the deck.

It will be seen in FIG. 4, which shows the cartridge in its open book state that the rectangular flange 15 integral with base plate 10 has dimensions slightly greater than the combined rectangular dimensions of compartments 16 and 17. The arrangement is such that when the book-like cartridge is closed, as shown in FIG. 1, covers 10 and 11 are then in parallel relation and the compartments nest within flange 15. In the closed book state, flange 15 which is then exposed to view then simulates the pages of the book sandwiched between its covers.

To latch the cartridge to maintain it in its closed book-like state, the upper wall of flange 15 is provided on its inner surface adjacent the upper corners of the flange with teeth 21T and 22T. These teeth, when the book is closed and compartments 16 and 17 nest within the flange, then engage detents 21D and 22D (see FIG. 5) on the front end walls of the compartments.

FIG. 6 shows, by way of example, the front face 23F of a typical word-puzzle card used in this game. The pair of words to be transformed are printed on the front face, and these words are WORD TREK, both words having the same number of letters. The steps necessary to transform the first word WORD to the second word TREK were previously described and will therefore not be repeated. But on the front face no information is given as to these steps, for it is the player who must figure them out.

However, on the front face of the card, there is also given the dictionary definition of each word. These definitions are not necessary to the game, but serve an incidental educational function. Some of the puzzle words used on the cards may be uncommon, and by being told by the card what the words mean, the player is able to enlarge his vocabulary.

On the rear face 23F of the card is printed a solution to the word puzzle presented on the front face of the card, the solution listing the steps necessary to transform the first word to the second.

In competition, the game may be played by two opposing players or by two opposing teams of players. The players set a time period during which when a card is presented to the players, a solution must be found by which the first word in the puzzle can be transformed into the second word. The player who is first to arrive at this solution wins a point. The number of cards that must be drawn to complete a game is determined in advance.

In playing the game, the word resulting from rearranging the letters of a word or by replacing one letter with another must in all cases be a dictionary word having a known meaning, otherwise the word is not acceptable. Hence in the course of playing the game, disputes may arise as to the acceptability of a word in solving the puzzle. These disputes are settled by consulting an unabridged dictionary, such as Webster's Third New International Dictionary; for unless the word is found therein, it does not qualify. In the event a word is rejected as not being a dictionary word, the player who formed this word loses a point. But if the player who challenged a word is found to be incorrect in that the word is found in the dictionary, then the challenger loses a point.

However, the rules of the word-puzzle game and how points are scored are not the concern of the present invention which resides in the structure and function of the book-like cartridge, as disclosed herein, to facilitate the playing of the game.

While there has been shown and described a preferred embodiment of a word-puzzle game cartridge in accordance with the invention, it will be appreciated that many changes and modifications may be made therein without, however, departing from the essential spirit thereof.

I claim:

1. A cartridge in a book format accommodating at least one deck of word-puzzle cards having predetermined dimensions, said cartridge comprising:

(a) a top plate and a substantially-identical base plate simulating the front and rear covers of a book, the top plate and the base plate each having an inner surface, which when the book is closed lie in parallel relation;

(b) a slat interhinging the base plate to simulate a spine of the book;

(c) a rectangular flange integral with the inner surface of the top plate and projecting therefrom to engage the inner surface of the base plate when the book is in a closed state; and (d) a compartment loaded with said deck of cards and having dimensions substantially corresponding to the dimensions of the deck formed by a wall integral with the inner surface of said base plate, said wall at its front end having a notch therein extending to the base plate to provide access to all cards in the deck so that they may be withdrawn from the compartment one card at a time, the dimensions of said compartment being such that the compartment nests within the rectangular flange when the book is in said closed state, and said flange then simulates the pages of a book sandwiched between its covers.

2. A cartridge as set forth in claim 1, wherein said cartridge is molded of synthetic plastic material and said slat is interhinged to said top and base plates by living hinges.

3. A cartridge as set forth in claim 11 accommodating two decks of cards and provided with a pair of compartments in side-by-side relation, each compartment having rectangular dimensions corresponding to those of a card and a height corresponding to the height of the deck accommodated therein.

4. A cartridge a set forth in claim 3, wherein said pair of compartments is defined by a wall having a rectangular form divided by a transverse partition into said pair of compartments.

5. A cartridge as set forth in claim 1, wherein said wall at its front end has a detent formed therein to be engaged by a complementary tooth in said flange to latch said cartridge in its closed state.

6. A cartridge as set forth in claim 1, wherein each card in the deck has printed on its front face a two-word puzzle and on its rear face a solution to this puzzle.

* * * * *

UNITED STATES PATENT AND TRADEMARK OFFICE

CERTIFICATE OF CORRECTION

PATENT NO. : 5,310,061

DATED : May 10, 1994

INVENTOR(S) : Maurice S. Kanbar

It is certified that error appears in the above-identified patent and that said Letters Patent is hereby corrected as shown below:

Col. 4, line 52, delete "11" and substitute --1--.

Signed and Sealed this

Sixteenth Day of August, 1994

*Attest:*

*Attesting Officer*

BRUCE LEHMAN

*Commissioner of Patents and Trademarks*